US006959838B2

(12) United States Patent
Eddins et al.

(10) Patent No.: US 6,959,838 B2
(45) **Date of Patent: *Nov. 1, 2005**

(54) TOY WATER GUN WITH DISTRIBUTOR WHEEL

(75) Inventors: Fred D. Eddins, Mapleville, RI (US); Robert L. Brown, North Kingstown, RI (US); Walter Bezaniuk, Berkley, MA (US)

(73) Assignee: Hasbro, Inc., Pawtucket, RI (US)

( * ) Notice: Subject to any disclaimer, the term of this patent is extended or adjusted under 35 U.S.C. 154(b) by 152 days.

This patent is subject to a terminal disclaimer.

(21) Appl. No.: 10/364,246

(22) Filed: Feb. 11, 2003

(65) Prior Publication Data

US 2004/0164090 A1 Aug. 26, 2004

Related U.S. Application Data

(63) Continuation-in-part of application No. 10/361,389, filed on Feb. 10, 2003.

(51) Int. Cl.[7] ..... A63H 3/18

(52) U.S. Cl. ..... 222/79; 222/385; 446/156; 446/159; 446/177; 446/475; 239/222.11; 239/222.17

(58) Field of Search ..... 222/78–79, 385, 222/383.1; 446/179–199, 159, 153, 156–158, 176–178, 180, 473, 475; 239/222.17, 231, 233, 223–224, 222.11; 124/81; 273/457

(56) References Cited

U.S. PATENT DOCUMENTS

| | | | | | |
|---|---|---|---|---|---|
| 1,163,152 | A | * | 12/1915 | Howard | 239/233 |
| 2,938,512 | A | * | 5/1960 | Smolen | 124/2 |
| 3,091,399 | A | * | 5/1963 | Kennedy | 239/222.13 |
| 3,422,828 | A | * | 1/1969 | Dommer | 134/138 |
| 3,509,584 | A | * | 5/1970 | Sable | 472/128 |
| 3,843,127 | A | * | 10/1974 | Lack | 273/349 |
| 3,871,582 | A | * | 3/1975 | Biddle | 239/233 |
| 4,077,629 | A | * | 3/1978 | Chestney | 273/349 |
| 4,591,071 | A | * | 5/1986 | Johnson | 222/39 |
| 4,757,946 | A | * | 7/1988 | Johnson | 239/99 |
| 4,780,922 | A | | 11/1988 | Sanchez | 15/29 |
| 5,224,652 | A | | 7/1993 | Kessler | 239/211 |
| 5,433,646 | A | * | 7/1995 | Tarng | 446/473 |
| 5,515,837 | A | * | 5/1996 | Nin et al. | 124/59 |
| 5,626,158 | A | * | 5/1997 | Gratopp | 134/138 |
| 5,816,275 | A | * | 10/1998 | Mullen | 134/141 |
| 5,906,295 | A | * | 5/1999 | D'Andrade | 222/79 |
| 5,975,358 | A | * | 11/1999 | Zheng et al. | 222/79 |
| 6,279,562 | B1 | | 8/2001 | Clayton | 124/59 |
| 6,364,219 | B1 | | 4/2002 | Zimmerman et al. | 239/394 |
| 6,594,843 | B1 | * | 7/2003 | Wilkins | 15/24 |

* cited by examiner

*Primary Examiner*—Frederick Nicolas
(74) *Attorney, Agent, or Firm*—Marshall, Gerstein & Borun LLP

(57) ABSTRACT

The present invention is directed to a toy gun system that may include a toy gun having a housing with a nozzle, wherein the toy water gun may be adapted to discharge an output stream of liquid through the nozzle. The toy gun system may further include a wheel fabricated from an absorbent material, and a support member mounted on the housing of the toy gun that may have the wheel rotatably mounted thereon. The wheel may be disposed proximate the nozzle of the toy gun and positioned such that at least a portion of the output stream of liquid impacts the at least a portion of the wheel to cause the wheel to rotate. The at least a portion of the liquid in the at least a portion of the output stream of liquid may be absorbed into the at least a portion of the wheel impacted by the at least a portion of the output stream of liquid, and the at least a portion of the liquid absorbed into the at least a portion of the wheel may be projected outwardly from the at least a portion of the wheel by resultant forces of the rotation of the wheel. At least one of the toy gun, the wheel and the support member may adapted to cause a sound to be generated by the toy gun system when the at least a portion of the of the output stream of liquid impacts the at least a portion of the wheel to cause the wheel to rotate.

27 Claims, 6 Drawing Sheets

TOY WATER GUN WITH DISTRIBUTOR WHEEL

REFERENCE TO RELATED APPLICATION

This is a continuation-in-part of U.S. patent application Ser. No. 10/361,389, filed Feb. 10, 2003 by Fred D. Eddins, Robert L. Brown and Walter Bezaniuk.

BACKGROUND OF THE INVENTION

The present invention is directed to a toy water squirt gun, and more particularly to a pressurized toy water squirt gun having a distributor wheel for distributing water from the squirt gun in a wide spray pattern.

Various toy guns wherein water is pressurized and discharged from the toy gun have been previously described. For example, U.S. Pat. No. 6,279,562 to Clayton discloses a toy gun which projects matter from a plurality of discharge ports, such as barrels or nozzles, which are irregularly located on the gun. The gun may incorporate a figurine in its structure to simulate an object such as a creature or a vehicle. The discharge ports may simulate a plurality of weapons carried by or on the figurine, such as cannons, machine guns, lasers or the like and may be adapted to project matter in solid or liquid forms, such as darts or water. A pump mechanism pressurizes gas or liquid, typically air or water, to facilitate the discharge of such projected matter. A distribution mechanism conducts the pressurized gas or liquid to the discharge ports.

U.S. Pat. No. 6,364,219 to Zimmerman et al. discloses a toy gun for discharging a shaped stream of liquid under pressure. The toy gun includes an expandable bladder located in a housing, and the expandable bladder is adapted to provide a generally constant pressure discharge of liquid contained therein. A release valve is connected to a trigger for regulating a discharge of liquid from the expandable bladder to a discharge outlet. A turret mounted rotatable nozzle assembly having a plurality of nozzles is connected to the housing. Each nozzle is selectively rotatable to a position in fluid communication with the discharge outlet. At least two of the plurality of nozzles include different shaped, non-circular stream nozzle orifice arrangements. Actuation of the trigger regulating the release of pressurized liquid through the discharge outlet and the selected one of the plurality of nozzles results in the liquid being discharged in a shaped stream having a generally constant form defined by the shape of the selected nozzle orifice arrangement.

SUMMARY OF THE INVENTION

In one aspect, the invention is directed to a toy gun system that may include a toy gun having a housing with a nozzle, wherein the toy water gun may be adapted to discharge an output stream of liquid through the nozzle. The toy gun system may further include a wheel fabricated from an absorbent material, and a support member mounted on the housing of the toy gun that may have the wheel rotatably mounted thereon. The wheel may be disposed proximate the nozzle of the toy gun and positioned such that at least a portion of the output stream of liquid impacts the at least a portion of the wheel to cause the wheel to rotate. The at least a portion of the liquid in the at least a portion of the output stream of liquid may be absorbed into the at least a portion of the wheel impacted by the at least a portion of the output stream of liquid, and the at least a portion of the liquid absorbed into the at least a portion of the wheel may be projected outwardly from the at least a portion of the wheel by resultant forces of the rotation of the wheel. At least one of the toy gun, the wheel and the support member may adapted to cause a sound to be generated by the toy gun system when the at least a portion of the of the output stream of liquid impacts the at least a portion of the wheel to cause the wheel to rotate.

In another aspect, the invention is directed to a liquid distribution assembly for a toy gun having a housing with a nozzle in which the toy water gun may be adapted to discharge an output stream of liquid through the nozzle. The liquid distribution assembly may further include a wheel fabricated from an absorbent material, and a support member mounted on the housing of the toy gun that may have the wheel rotatably mounted thereon. The wheel may be disposed proximate the nozzle of the toy gun and positioned such that at least a portion of the output stream of liquid impacts the at least a portion of the wheel to cause the wheel to rotate. The at least a portion of the liquid in the at least a portion of the output stream of liquid may be absorbed into the at least a portion of the wheel impacted by the at least a portion of the output stream of liquid, and the at least a portion of the liquid absorbed into the at least a portion of the wheel may be projected outwardly from the at least a portion of the wheel by resultant forces of the rotation of the wheel. The liquid distribution assembly may further include a sound generation mechanism mounted on at least one of the toy water gun, the wheel and the support member, and may be adapted to generate a sound when the at least a portion of the of the output stream of liquid impacts the at least a portion of the wheel to cause the wheel to rotate.

Additional aspects of the invention are defined by the claims of this patent.

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Figure 1:
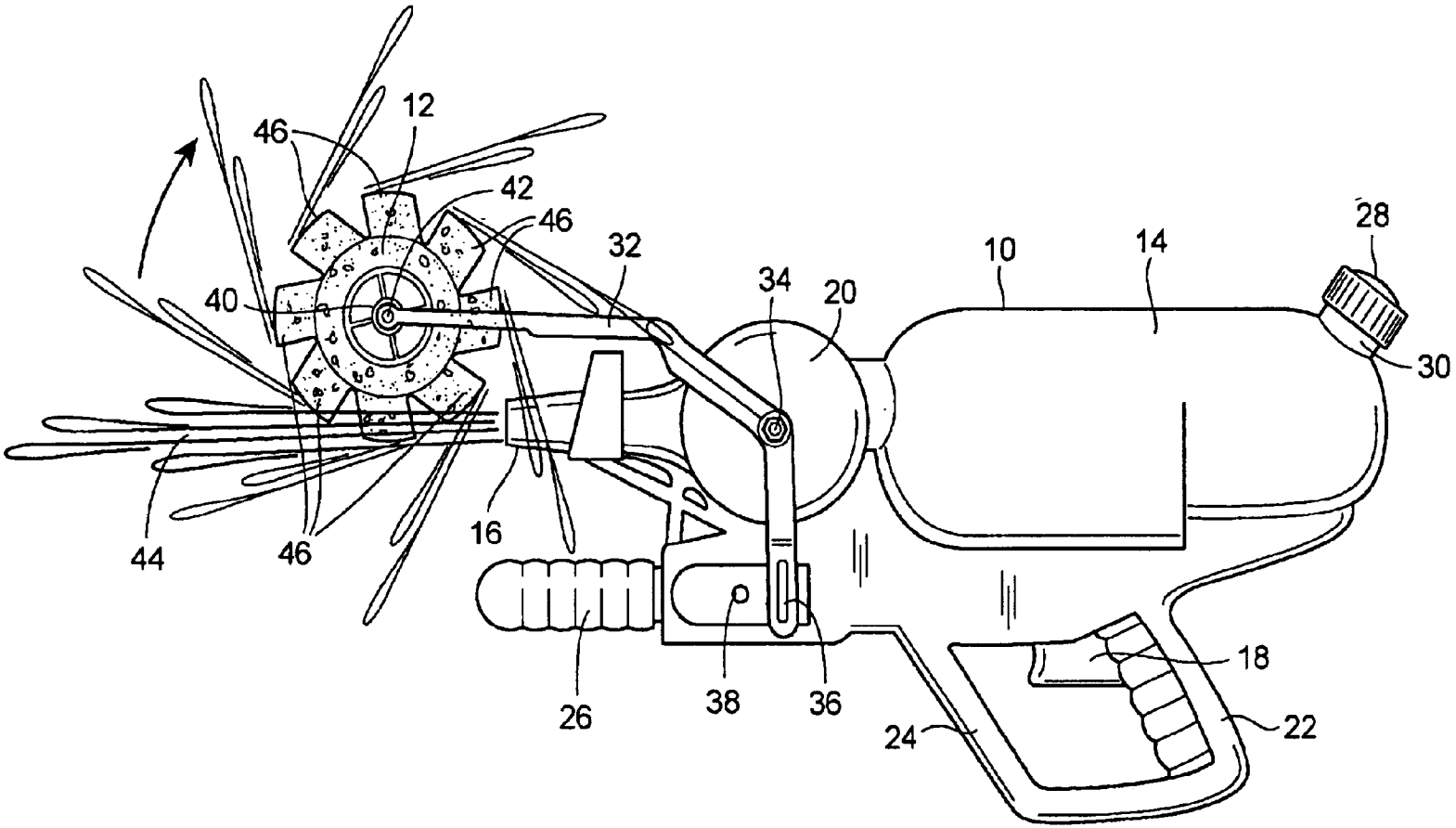
FIG. 1 is a side view of a toy water gun and an embodiment of a distributor wheel in an operative position.
Figure 2:
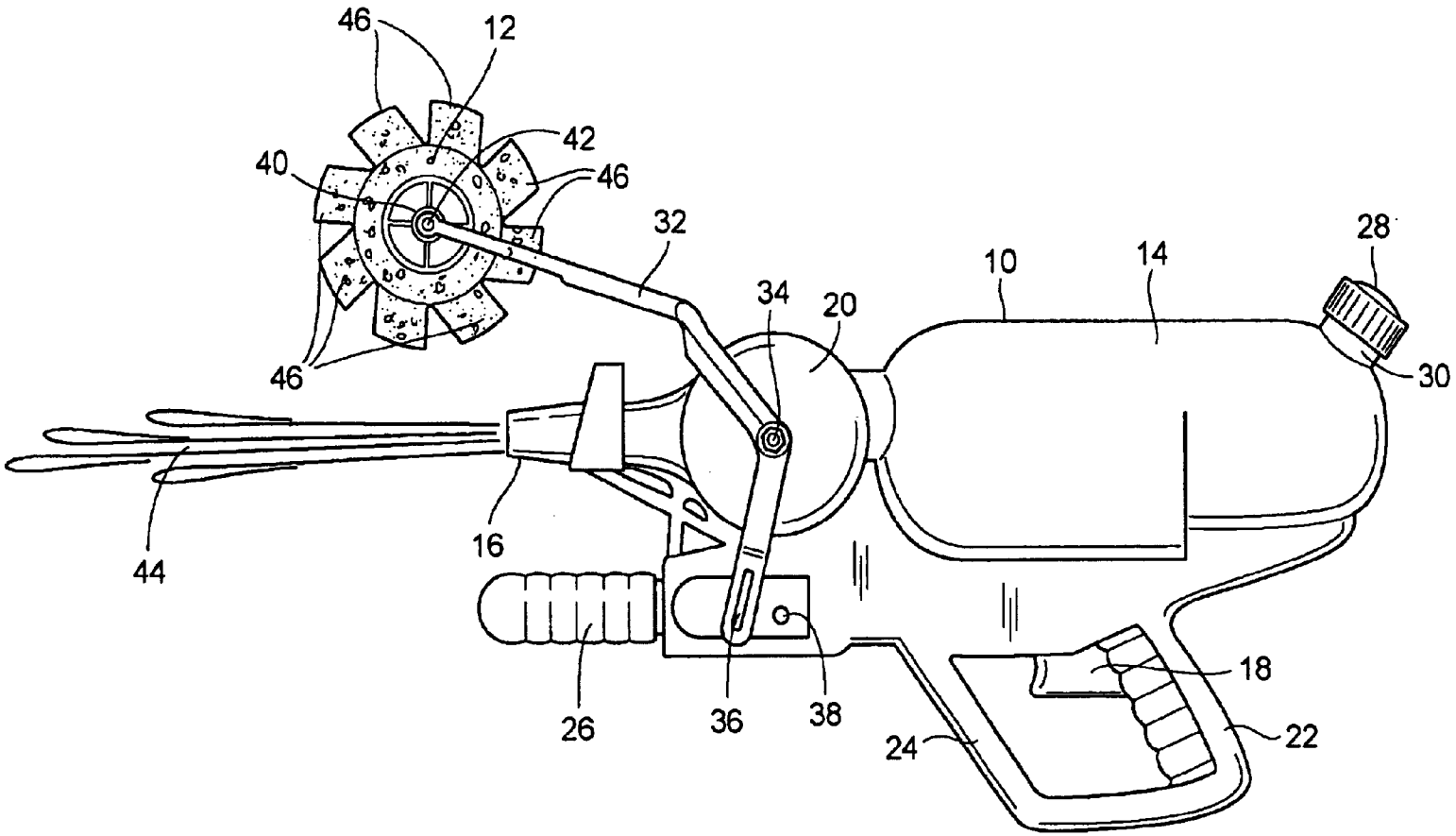
FIG. 2 is a side view of the toy water gun and distributor wheel of FIG. 1 with the distributor wheel in an inoperative position.
Figure 3:
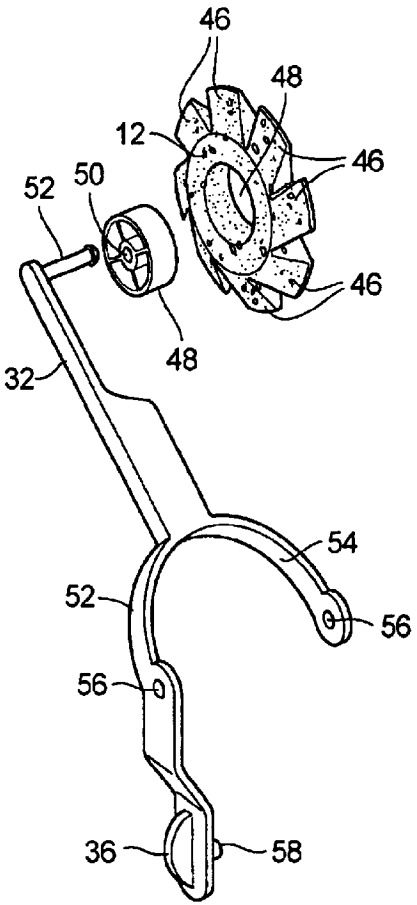
FIG. 3 is a partial exploded view of the distributor wheel and support arm of FIG. 1.
Figure 4:
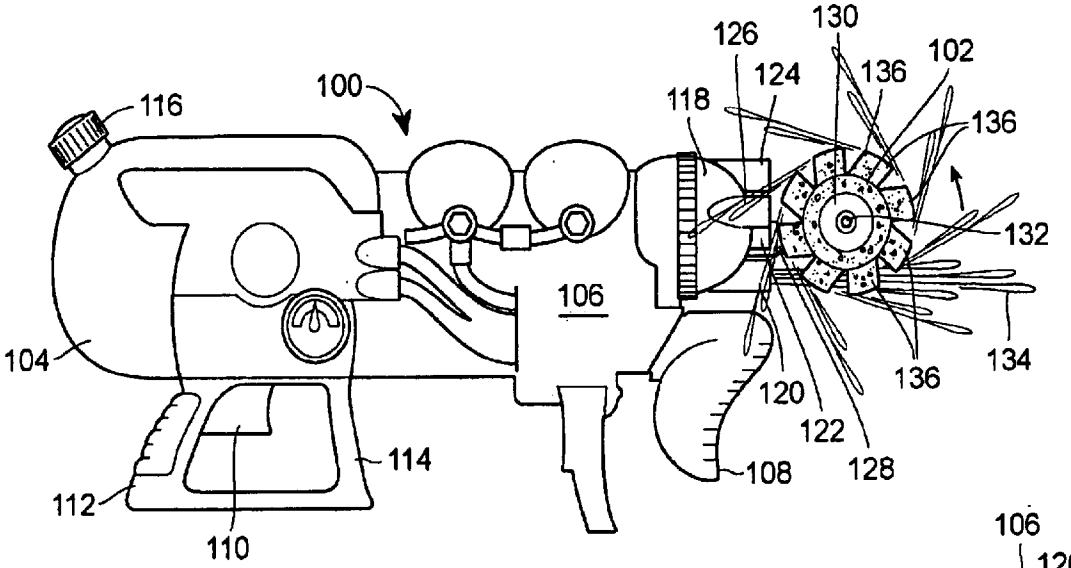
FIG. 4 is a side view of a toy water gun and an alternative embodiment of a distributor wheel in a first operative position.

FIGS. 1–3 illustrate one embodiment of a toy water gun 10 having a distributor wheel 12. Referring to FIG. 1, the toy water gun 10 may be a pressurized toy water squirt gun having a self-contained mechanism for pressurizing a tank 14 with air, thereby creating a pressure differential between the pressurizing mechanism and the ambient atmosphere so that the water may be propelled from the toy water gun 10 through a nozzle 16 when the user pulls a trigger 18. One example of a toy water gun having a pressurizing mechanism for propelling water is illustrated and described in U.S. Pat. No. 5,305,919, entitled "Pinch Trigger Hand Pump Water Gun with Non-Detachable Tank," which issued on Apr. 26, 1994, and which is hereby expressly incorporated by reference herein in its entirety. Of course, other configurations of toy water guns having pressurizing mechanisms for propelling water are well known and will be understood by those skilled in the art as being useful with water distributor wheels as described herein.

As previously discussed, the toy water gun 10 includes a tank 14 that may hold a quantity of water or other liquid that may be pressurized by an internal pressurizing mechanism, with the liquid being propelled outwardly through the nozzle 16 when a user activates the trigger 18. The toy water gun 10 may include a housing 20 to which the tank 14 may be connected or in which the tank 14 may be disposed. The housing 20 may include a handle 22 that may include a trigger guard 24 defining an opening in which the trigger 18 may be disposed. In order to allow the user to pressurize the pressurizing mechanism disposed in within the housing 20, the toy water gun 10 may further include a pump handle 26 extending outwardly from the housing 20 that may be attached to, for example, a piston that may pressurize the tank 14 when the pump handle 26 is pumped by the user of the toy water gun 10. In order to add water or other liquids to the tank 14, a removable cap 28 may be attached to a fill port 30 of the tank 14. To fill the tank 14, the cap 28 may be removed from the fill port 30 so that the desired liquid may be poured into the tank 14. After the desired liquid is poured into the tank 14, the capped 28 may be reattached to the fill port in a manner that forms a substantially airtight and watertight seal to prevent the liquid from leaking out of the tank 14 and to allow the tank 14 to be pressurized by the pressurizing mechanism.

The distributor wheel 12 may be connected to the housing 20 proximate the nozzle 16 by a support arm 32. The support arm 32 may be pivotally mounted to the housing 20 by a pivot pin 34, rivet or other connection mechanism so that the support arm 32 and wheel 12 attached thereto may rotate with respect to the housing 20. In order to position the support arm 32, the support arm 32 may include a grip 36 that may be grasped by the user to move the support arm 32 and wheel 12 to the desired position. The support arm 32 may be retained in one or more discrete positions by means of a corresponding number of depressions 38 in the housing 20 that receive a corresponding detent element (not shown) of the support arm 32 to hold the support arm 32 in a given position until the user applies force to the support arm 32 to unseat the detent element from the depressions 38 in which the detent element is disposed.

The wheel 12 may be pivotally mounted to the support arm 32 to facilitate free rotation of the wheel 12. The wheel 12 may be mounted on a bushing 40 that in turn may be pivotally connected to the support arm 32 by a pivot pin 42 or other connection mechanism such that the wheel 12 and bushing 40 rotate about the pivot pin 42 or mechanism. The support arm 32 may be configured so that the wheel 12 may be disposed proximate the nozzle 16 and, consequently, an output stream of liquid 44. Because the support arm 32 is rotatable relative to the housing 20, the wheel 12 may be moved between an operative position (FIG. 1) wherein the wheel 12 is engaged by the output stream of liquid 44, and an inoperative position (FIG. 2) wherein the toy water gun 10 may be utilized in a normal manner to spray the output stream of liquid 44 without engaging the wheel 12.

In the embodiment shown in FIG. 1, the wheel 12 may be disposed in the operative position when the user grasps the grip 36 to dispose the detent element of the support arm 32 in a rearward depression 38 (not shown) with a lower edge of the wheel 12 aligned with the nozzle 16 so that the output stream of liquid 44 engages a plurality of outwardly extending fins 46 of the wheel 12. The wheel 12 may be fabricated from foam rubber or other semi-absorbent material into which at least a portion of the output stream of liquid 44 may be absorbed as the output stream of liquid 44 is discharged from the nozzle 16 when the user pulls the trigger 18. As the output stream of liquid 44 is discharged from the nozzle 16, at least a portion of the output stream of liquid 44 may impact the fins 46 of the wheel 12 to cause the wheel 12 and bushing 40 to rotate about the pivot pin 42 in the direction indicated by the arrow. At the same time, at least a portion of the output stream of liquid 44 may be absorbed by the wheel 12 at the fins 46 as the fins 46 pass through the output stream of liquid 44. As the fins 46 rotate out of alignment with the output stream of liquid 44, the centrifugal force of the rotating wheel 12 may cause the liquid absorbed by the wheel 12 to move outwardly toward the edges of the fins 46 and to ultimately spray outwardly from the rotating wheel 12 in a wide spray pattern with a plane that may be substantially perpendicular to the rotational axis of the wheel 12. When the trigger 18 is released, the output stream of liquid 44 subsides, with rotation of the wheel 12 ultimately ceasing due to the friction between the bushing 40 and pin 42.

Referring to FIG. 2, the wheel 12 may be moved to the inoperative position by grasping the grip 36 to disengage the detent member from the rearward depression 38 and moving the detent member into engagement with the forward depression 38 (not shown). As the support arm 32 is rotated, the wheel 12 moves upwardly out of alignment with the output stream of liquid 44 discharged from the nozzle 16. When desired, the wheel 12 can be returned to the operative position by rotating the support arm 32 back to the position illustrated in FIG. 1.

Referring to FIG. 3, an embodiment of the support arm 32 and wheel 12 assembly is illustrated with the components partially detached. The wheel 12 may include an opening 48 into which the bushing 40 may be inserted such that the wheel 12 and bushing 40 may rotate together under the influence of the output stream of liquid 44. The bushing 40 may further include an opening 50 into which the pivot pin 42 may be inserted to connect the bushing 40 and wheel 12 to the support arm 32 and to facilitate rotation of the bushing 40 and wheel 12 under the impact of the output stream of liquid 44. Portions 52 and 54 of the support arm 32 may be configured to be disposed on either side of the housing 20 and include openings 56 in which pivot pins 34 or other connection mechanisms may be inserted to connect the portions 52, 54 to the housing 20. The portion 52 may further include the grip 36 disposed on an outward side and a detent 58 disposed on an inward side, with the detent 58 being adapted to engage and seat in the depressions 38 of the housing 20.

While the support arm 32 is illustrated in FIGS. 1–3 and described in the accompanying text as being pivotally mounted to the housing 20, it will be understood by those skilled in the art that the support arm 32 may be configured and moved in any manner that will facilitate movement of the wheel 12 between an operative position wherein the wheel 12 is engaged by at least a portion of the output stream of liquid 44, and an inoperative position wherein the output stream of liquid 44 does not act on the wheel 12. For example, the support arm 32 may be connected to the housing 20 such that a linear movement of the support arm 32 may be used to move the wheel 12 between the inoperative and the operative positions. Still further, a linkage or other mechanism may be used to connect the wheel 12 to the housing 20 such that a first type of movement by a component of the connection mechanism, such as linear movement, may cause a corresponding second type of movement of the wheel 12, such as rotational movement or a complex motion, to move the wheel 12 between the operative and the inoperative positions. Other mechanisms and types of motions may be used to move the wheel 12 between the operative and the inoperative position and will be understood by those having skill in the art as having use with a toy water gun with a distributor wheel in accordance with the invention.

Referring now to FIGS. 4–7, an alternative embodiment of a toy water gun 100 and distributor wheel 102 is illustrated. Similar to the toy water gun 10, the toy water gun 100 may be a pressurized toy water squirt gun having self-contained pressurizing mechanism to create a pressure differential between a reservoir or tank 104 and the ambient atmosphere to propel water from the toy water gun 100. In addition to the pressurization mechanism disposed within a housing 106 of the toy water gun 100, the toy water gun 100 may include a pump handle 108 and trigger 110 extending outwardly from the housing 106, with the trigger 110 being disposed within an opening defined by a handle 112 and trigger guard 114. The toy water gun 100 may further include a removable cap 116 attached to a fill port (not shown) that may be removed to allow a user to fill the tank 104 with liquid. The toy water gun 100 may further include a rotatable barrel mounted on the housing 106 and having a plurality of nozzles 120–126 that may be alternately aligned with an outlet port (not shown) of the pressurizing mechanism such that an output stream of liquid may be propelled from the respective one of the nozzles 123–126 aligned with the outlet port. The wheel 102 may be mounted on one of the nozzles 122 by a support arm 128 to facilitate positioning the wheel 102 in one or more operative positions or inoperative positions as described more fully below. The wheel 102 may be mounted on a bushing 130 which may be connected to the support arm 128 by a pivot pin 132 to facilitate rotation of the wheel 102 and bushing 130 about the pivot pin 132.

Figure 5:
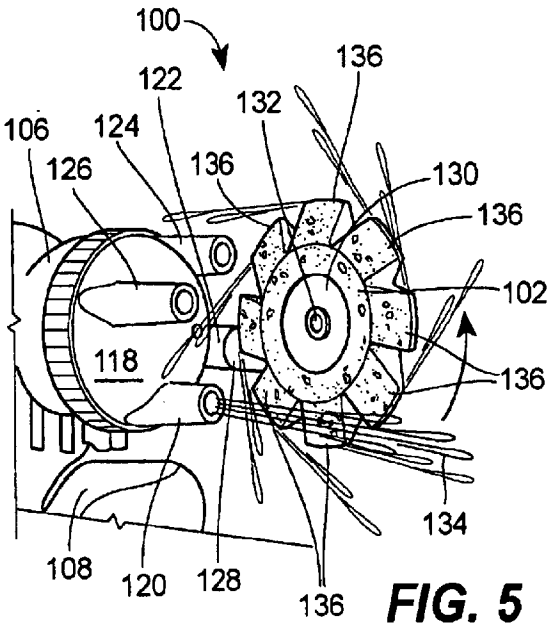
FIG. 5 is a partial perspective view of the toy water gun and distributor wheel of FIG. 4.

The wheel 102 is shown in a first operative position of FIG. 5. As with the wheel 12, the wheel 102 may be fabricated from foam rubber or other semi-absorbent material so that at least a portion of an output stream of liquid 134 may be absorbed into the wheel 102 at fins 136. As the output stream of liquid 134 is propelled from the nozzle 120, the output stream of liquid 134 impacts the fins 136 to cause the wheel 102 to rotate in the direction indicated by the arrow about the axis of the pivot pin 132, which may be disposed approximately horizontally. Concurrently, at least a portion of the output stream of liquid 134 may be absorbed into the wheel 102 at the fins 136 as they rotate into alignment with the output stream of liquid 134. As the wheel 102 rotates, the centrifugal force caused by the rotation of the wheel 102 may cause the absorbed liquid to move outwardly toward the edges of the fins 136 and to ultimately spray outwardly from the wheel 102 in a wide spray pattern within a substantially vertical plane. When the trigger 110 is released, the output stream of liquid 134 subsides, with the rotation of the wheel 102 ultimately ceasing due to the friction between the bushing 130 and pin 132.

Figure 6:
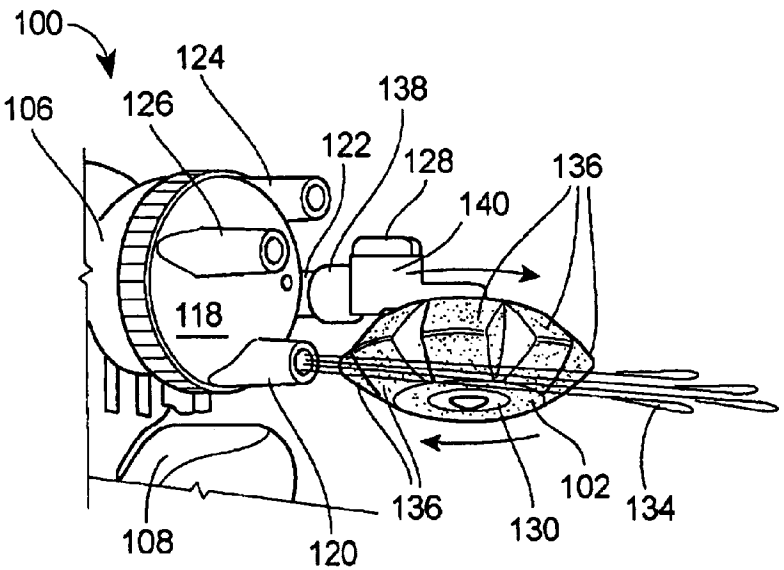
FIG. 6 is a partial perspective view of the toy water gun and distributor wheel of FIG. 4 in a second operative position.

Referring now to FIG. 6, the wheel 102 may be disposed in second operative position wherein the wheel 102 and bushing 130 may rotate about a substantially vertical axis defined by the pivot pin 132. To facilitate rotating the wheel 102 between the first operative position and the second operative position, the support arm 128 may include a first portion 138 connected to and substantially stationary with respect to the nozzle 122, and a second portion 140 that may be rotatably mounted to the first portion 138, with the wheel 102 and bushing 130 rotatably mounted on the second portion 140 by the pivot pin 132. In order to adjust the position of the wheel 102, the second portion 140 of the support arm 128 may be rotated relative to the first portion 138, thereby setting the wheel 102 in the desired position.

The first and second portions 138 and 140 may be configured so that the second portion 140 may occupy a plurality of discrete positions wherein mating elements of the first and second portions 138 and 140 maintain the relative positions of the first and second portions 138 and 140 until the user applies a force to move the wheel 102 to a different one of the discrete positions. In the second operative position, at least a portion of the output stream of liquid 134 impacts the fins 136 of the wheel 102 to cause the wheel 102 to rotate in the direction indicated by the arrows. As with the first operative position, at least a portion of the output stream of liquid 134 may be absorbed by the fins 136 as they rotate into alignment with the output stream of liquid 134. As the wheel 102 continues to rotate, the absorbed liquid moves towards the edges of the fins 136 due to the centrifugal force caused by the rotation of the wheel 102 to cause the liquid to be sprayed from the wheel 102 in a wide spray pattern initially in a substantially horizontal plane until the force of gravity causes the liquid to fall downwardly.

Figure 7:
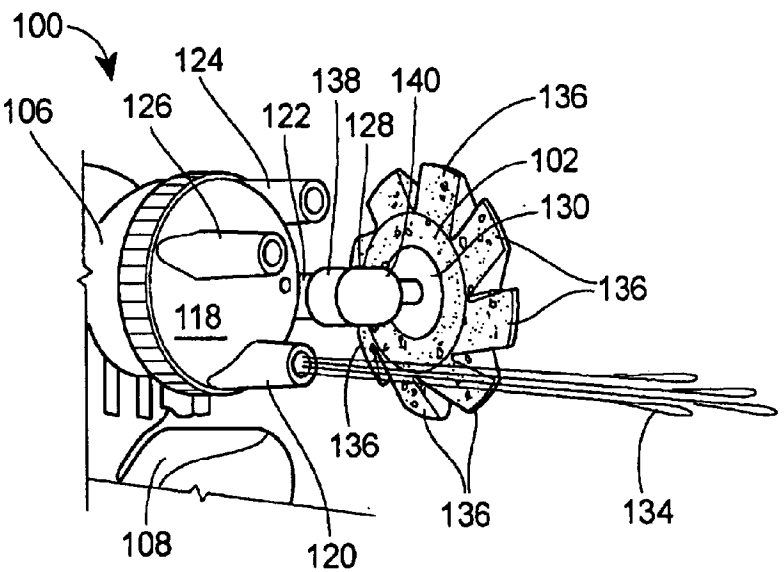
FIG. 7 is a partial perspective view of the toy water gun and distributor wheel of FIG. 4 in a second inoperative position.

To move the wheel 102 to an inoperative position, the second portion 140 of the support arm 128 may be further rotated with respect to the first portion 138 to a position shown in FIG. 7. In the inoperative position, the wheel 102 is disposed out of alignment with the output stream of water 134 from the nozzle 120 such that the output stream of liquid 134 may not impact the fins 136 or any other portion of the wheel 102. To return the wheel 102 to one of the operative positions, the second portion 140 of the support arm 128 may be further rotated relative to the first portion 138 to bring the wheel 102 back into alignment with the output stream of the liquid 134, such as in one of the positions illustrated in FIGS. 5 and 6. As with the previous embodiment, those skilled in the art will appreciate that other connection mechanisms and types of movement may be implemented to cause the wheel 102 to move between one or more operative positions and inoperative positions.

Figure 9:
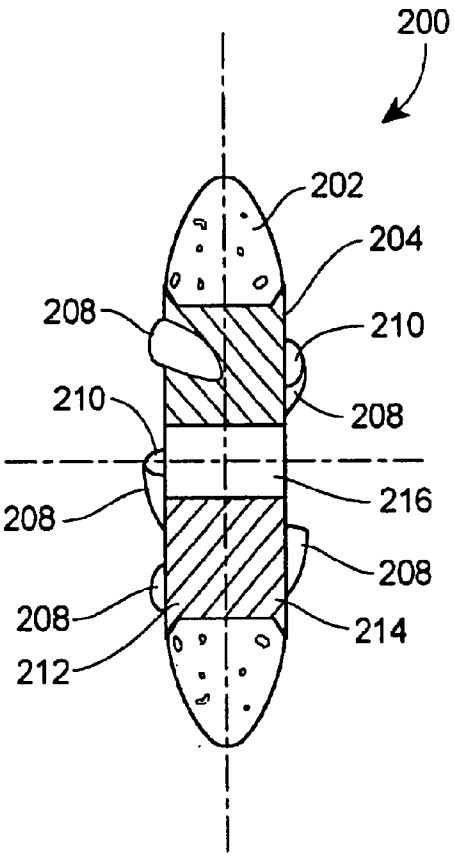
FIG. 9 is a cross-sectional view through line 9—9 of the distributor wheel and bushing of FIG. 8 with the axle removed.
Figure 8:
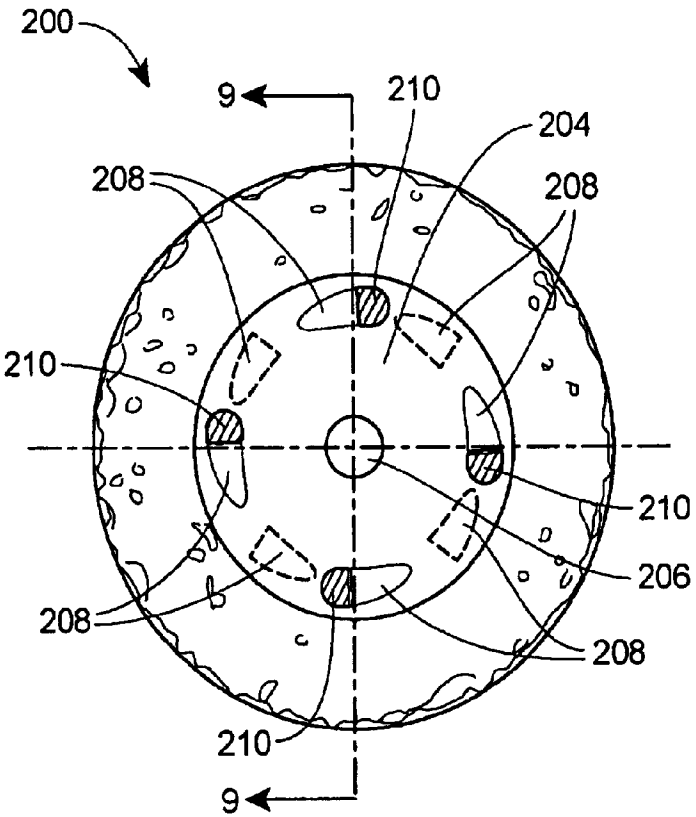
FIG. 8 is a side view of another alternative embodiment of a distributor wheel.

The play value of a toy water gun having a distributor wheel as described herein may be enhanced by generating sounds when the toy water gun discharges the output stream of liquid causing the distributor wheel to rotate. Such sounds may be generated mechanically, electro-mechanically or electronically using mechanisms known in the art. One example of a mechanical mechanism for generating sounds when a distributor wheel rotates is illustrated in FIGS. 8 and 9. Referring to FIG. 8, a liquid distribution assembly 200 may include a wheel 202 fabricated as a foam disk mounted on a bushing 204, which in turn may be mounted on an axle 206 to facilitate rotation of the wheel 202 and bushing 204. The bushing 204 may include one or more air intake ports 208 disposed on either surface of the bushing 204. Each air intake port 208 may include an opening 210 into an inner cavity of the air intake port 208, with each air intake port 208 being oriented such that the openings 210 are disposed at a leading end of the air intake ports 208 when the wheel 202 rotates in the directions indicated by the arrow due to the impact of the output stream of liquid from the nozzle of the toy water gun.

As the wheel 202 rotates in the direction indicated by the arrow, air enters the cavities of the air intake ports 208 through the openings 210. When the wheel 202 rotates with sufficient minimum velocity, the air rushing into and over the openings 210 of the air intake ports 208 may cause a resonance that produces a sound in a similar manner that sound may be produced by blowing into the opening of a soft drink bottle. The sound may continue until the rotation of the wheel 202 slows to a velocity that is less than the minimum velocity required to produce the sound. As shown in FIG. 9, the bushing 204 of the liquid distribution assembly 200 may be formed from a left bushing portion 212 and a right bushing portion 214 that may be connected to each other, with each portion 212 and 214 defining a portion of an opening 216 in which the axle 206 may be disposed. In the embodiment shown, the air intake ports 208 on the opposite surfaces of the portions 212 and 214 may be offset, such that the air intake ports 208 may be punched through the corresponding portion 214 in a similar manner as an air intake of a car hood, thereby defining the cavity of the air intake ports 208. When the portions 212 and 214 are connected, the cavity of the air intake ports 208 of one of the portions 212 and 214 may be enclosed by the inner surface of the other of the portions 212 and 214. Of course, other mechanical mechanisms for generating a desired noise when the distributor wheel 202 rotates will be apparent to those skilled in the art. For example, the bushing may be configured with spoke-like members that may be engaged by a corresponding thin, flat member to generate sound in a similar manner as taping a card to the fork of a bicycle to generate sound when the card is engaged by a spokes of the bicycle wheel.

Figure 10:
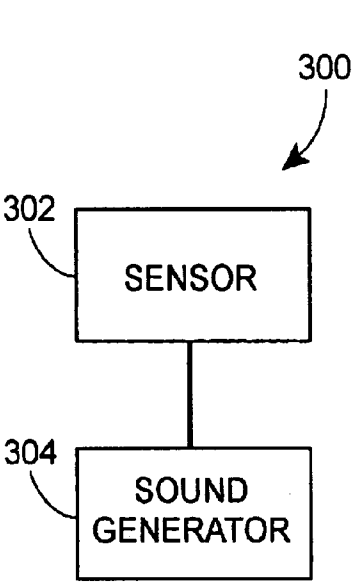
FIG. 10 is a block diagram of an embodiment of a sound generation mechanism for a toy water gun and distributor wheel.

Alternatively, the desired sound may be generated electronically by sensing the activation of the toy water gun or movement of the distributor wheel, and thereby causing an electronic sound to be output from the toy water gun. FIG. 10 is a schematic illustration of an embodiment of an electronic sound generation mechanism 300 for a toy water gun and distributor wheel. The sound generation mechanism 300 may include a sensor 302 capable of detecting actuation, movement or other operating conditions of a toy water gun and distributor wheel. The sensor 302 may be operatively coupled to a sound generator 304 such that the sensor 302 may transmit a signal to the sound generator 304 indicative of the activation of the toy water gun to discharge an output stream of liquid and cause the distributor wheel to rotate. When the sound generator 304 receives signals transmitted by the sensor 302, the sound generator 304 may cause a desired sound to be broadcast from the toy water gun that may be audible to the user and/or others in proximity to the toy water gun.

The sensor 302 may be any type of electrical or electromechanical sensor capable of detecting the operation of the toy water gun and/or the rotation of the distributor wheel. For example, the sensor 302 may be a photoelectric sensor disposed proximate a distributor wheel such that the photoelectric sensor may detect changes in the amount or characteristics of light proximate the photoelectric sensor and caused by the rotation of the distributor wheel. Upon detecting changes in the light, the photoelectric sensor may transmit corresponding signals to the sound generator 304 to cause the sound generator 304 to output the desired sound. As another example, the sensor 302 may be a liquid flow sensor positioned proximate a nozzle of the toy water gun such that the flow sensor may detect the discharge of the output stream of liquid from the nozzle when the toy water gun is activated. Upon detecting the discharge of the output stream of liquid, the flow sensor may transmit appropriate signals to the sound generator 304 to cause the sound generator 304 to output the desired sound. As a further example, the sensor 302 may be a switch operatively coupled to a trigger of the toy water gun such that the switch may be open when the trigger is in its normal position, and the switch may be closed when the trigger is pulled to discharge the output stream of liquid from the toy water gun. The closing of the switch may in turn cause the actuation of the sound generator 304 to output the desired sound. Other types of sensors 302 capable of detecting operating conditions associated with the activation of the toy water gun and the rotation of the distributor wheel, such as pulling the trigger, discharging an output stream of liquid from a nozzle, rotating the distributor wheel, and the like, capable of transmitting signals to actuate the sound generator 304 will be understood by those skilled in the art as having use in the sound generation mechanism 300.

The sound generator 304 may be any electronic or electromechanical device capable of receiving the output signals from the sensor 302 and outputting desired sound programmed or stored therein. For example, the sound generator 304 may include a controller implemented on a circuit board and containing the control logic and sound generation data implemented via circuitry contained on a conventional printed circuit board, with the control logic and sound generation data being stored directly on the printed circuit board. It should also be appreciated that although the controller may be implemented on a printed circuit board, more complex implementations of the sound generator 304 may be implemented wherein the controller may comprise, among other components, a program memory, a microcontroller or microprocessor (MP), a random-access memory (RAM), read-only member (ROM), and an input/output (I/O) circuit, all of which may be interconnected. It should further be appreciated that the controller may include multiple microprocessors. Similarly, the memory of the controller may include multiple RAMs and multiple program memories depending on the complexity and requirements of a specific implementation. It should also be appreciated that the I/O circuit may include a number of different types of I/O circuits, such as light-generation circuits, sound-generation circuits, and the like. The RAMs, ROMs and program memories may be implemented as semi-conductor memories, magnetically readable memories, and/or optically readable memories, for example. Moreover, the sound generator 304 may include a speaker or other mechanical, or electro-mechanical device capable of outputting a desired sound when the sensor 302 transmits signals to the sound generator 304. Other configurations of sound generating mechanisms 300 will be understood by those skilled in the art as having use and being capable of implementation in a toy water gun having a distributor wheel.

While the preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed is:

1. A toy gun system comprising:

a toy water gun having a housing with a nozzle, the toy water gun discharging an output stream of liquid through the nozzle;

a wheel fabricated from an absorbent material; and a support member mounted on the housing of the toy water gun and having the wheel rotatably mounted thereon, the wheel being positioned downstream from the nozzle such that at least a portion of the output stream of liquid impacts at least a portion of the wheel to cause the wheel to rotate, and at least a portion of the wheel being disposed external to the housing, wherein at least a portion of the liquid in the at least a portion of the output stream of liquid is absorbed into the at least a portion of the wheel impacted by the at least a portion of the output stream of liquid, and wherein the at least a portion of the liquid absorbed into the at least a portion of the wheel is projected outwardly from the at least a portion of the wheel by resultant forces of the rotation of the wheel.

2. A toy gun system as defined in claim 1, wherein the support member is moveably mounted on the housing of the toy water gun, the support member moving between a first operative position with the axis of rotation of the wheel disposed in a first direction and wherein the at least a portion of the output stream of liquid impacts the at least a portion of the wheel to cause the wheel to rotate, and an inoperative position wherein the wheel is not impacted by the output stream of liquid.

3. A toy gun system as defined in claim 2, wherein the support member is rotatably mounted on the housing of the toy water gun, and wherein the wheel moves through an arcuate path between the first operative position and the inoperative position.

4. A toy gun system as defined in claim 2, wherein the support member moves the wheel to a second operative position with the axis of rotation of the wheel disposed in a second direction and wherein the at least a portion of the output stream of liquid impacts the at least a portion of the wheel to cause the wheel to rotate.

5. A toy gun system as defined in claim 2, wherein the housing of the toy water gun comprises a first depression corresponding to the first operative position and a second depression corresponding to the inoperative position, and the support member comprises a detent member, wherein the detent member is disposed within the first depression when the wheel is in the first operative position, and the detent member is disposed within the second depression when the wheel is in the inoperative position.

6. A toy gun system as defined in claim 1, further comprising:

a bushing connected to the wheel; and a pivot pin connected to the bushing and to the support member, wherein the wheel and the bushing rotate about an axis defined by the pivot pin.

7. A toy gun system as defined in claim 1, wherein at least one of the toy water gun, the wheel and the support member causes a sound to be generated by the toy gun system when the at least a portion of the output stream of liquid impacts the at least a portion of the wheel to cause the wheel to rotate.

8. A toy gun system as defined in claim 2, wherein the support member comprises a first portion connected to the toy water gun, and a second portion rotatably connected to the first portion of the support member and having the wheel rotatably mounted thereon, wherein the second portion of the support member rotates relative to the first portion of the support member to move the wheel between the first operative position and the inoperative position.

9. A toy gun system as defined in claim 1, wherein the wheel comprises a plurality of fins, wherein the fins are alternately engaged by the at least a portion of the output stream of liquid as the wheel rotates, and wherein the fins absorb the at least a portion of the liquid.

10. A liquid distribution assembly for a toy water gun having a housing with a nozzle, the toy water gun discharging an output stream of liquid through the nozzle, the liquid distribution assembly comprising:

a wheel fabricated from an absorbent material; and a support member mounted on the housing of the toy water gun and having the wheel rotatably mounted thereon, the wheel being positioned downstream from the nozzle such that at least a portion of the output stream of liquid impacts at least a portion of the wheel to cause the wheel to rotate, and at least a portion of the wheel being disposed external to the housing;

wherein the at least a portion of the liquid in the at least a portion of the output stream of liquid is absorbed into the at least a portion of the wheel impacted by the at least a portion of the output stream of liquid, and wherein the at least a portion of the liquid absorbed into the at least a portion of the wheel is projected outwardly from the at least a portion of the wheel by resultant forces of the rotation of the wheel.

11. A liquid distribution assembly as defined in claim 10, wherein the support member is moveably mounted on the housing of the toy water gun, the support member moves between a first operative position with the axis of rotation of the wheel disposed in a first direction and wherein the at least a portion of the output stream of liquid impacts the at least a portion of the wheel to cause the wheel to rotate, and an inoperative position wherein the wheel is not impacted by the output stream of liquid.

12. A liquid distribution assembly as defined in claim 11, wherein the support member is rotatably mounted on the housing of the toy water gun, and wherein the wheel moves through an arcuate path between the first operative position and the inoperative position.

13. A liquid distribution assembly as defined in claim 11, wherein the support member moves the wheel to a second operative position with the axis of rotation of the wheel disposed in a second direction and wherein the at least a portion of the output stream of liquid impacts the at least a portion of the wheel to cause the wheel to rotate.

14. A liquid distribution assembly as defined in claim 11, wherein the housing of the toy water gun has a first depression corresponding to the first operative position of the wheel and a second depression corresponding to the inoperative position of the wheel, the support member comprises a detent member, the support member being adapted such that the detent member is disposed within the first depression when the wheel is in the first operative position, and the detent member is disposed within the second depression when the wheel is in the inoperative position.

15. A liquid distribution assembly as defined in claim 10, further comprising:

a bushing connected to the wheel; and a pivot pin connected to the bushing and to the support member, wherein the wheel and the bushing rotate about an axis defined by the pivot pin.

16. A liquid distribution assembly as defined in claim 15, wherein the sound generation mechanism comprises a plurality of air intake ports extending outwardly from a surface of the bushing, the air intake ports generating sound due to airflow at the air intake ports due to the rotation of the wheel.

17. A liquid distribution assembly as defined in claim 10, comprising a sound generation mechanism mounted on at least one of the toy water gun, the wheel and the support member, the sound generation mechanism generating a sound when the at least a portion of the output stream of liquid impacts the at least a portion of the wheel to cause the wheel to rotate.

18. A liquid distribution assembly as defined in claim 17, wherein the sound generation mechanism comprises:

a sensor one of disposed proximate the wheel to detect rotation of the wheel and to generate an output signal when the sensor detects rotation of the wheel, and disposed proximate the nozzle to detect the discharge of the output stream of liquid at the nozzle and to generate an output signal when the sensor detects the discharge of the output stream of liquid at the nozzle; and a sound generator operatively coupled to the sensor and generating a sound when the sensor generates the output signal.

19. A liquid distribution assembly as defined in claim 17, wherein the toy water gun comprises a trigger causing the discharge of the output stream of liquid at the nozzle when the trigger moves to a discharge position, and wherein the sound generation mechanism comprises:

a sensor disposed proximate the trigger to detect the movement of the trigger to the discharge position and to generate an output signal when the sensor detects the movement of the trigger to the discharge position; and a sound generator operatively coupled to the sensor to generate a sound when the sensor generates the output signal.

20. A liquid distribution assembly as defined in claim 11, wherein the support member comprises a first portion connected to the toy water gun, and a second portion rotatably connected to the first portion of the support member and having the wheel rotatably mounted thereon, wherein the second portion of the support member rotates relative to the first portion of the support member to move the wheel between the first operative position and the inoperative position.

21. A liquid distribution system as defined in claim 10, wherein the wheel comprises a plurality of fins, wherein the fins are alternately engaged by the at least a portion of the output stream of liquid as the wheel rotates, and wherein the fins absorb the at least a portion of the liquid.

22. A toy gun system comprising:

a toy water gun having a housing with a nozzle, the toy water gun discharging an output stream of liquid through the nozzle;

a wheel; and a support member mounted on the housing of the toy water gun and having the wheel rotatably mounted thereon, the wheel being positioned downstream from the nozzle such that at least a portion of the output stream of liquid impacts the wheel to cause the wheel to rotate, and at least a portion of the wheel being disposed external to the housing, wherein at least a portion of the liquid in the at least a portion of the output stream of liquid impacts the wheel and is engaged by the wheel such that the portion of the liquid rotates with the wheel, and wherein the portion of the liquid engaged by the wheel is projected outwardly from the wheel by resultant forces of the rotation of the wheel.

23. A toy gun system as defined in claim 22, wherein the wheel is fabricated from an absorbent material.

24. A toy gun system as defined in claim 22, wherein at least one of the toy water gun, the wheel and the support member causing a sound to be generated by the toy gun system when the at least a portion of the output stream of liquid impacts the wheel to cause the wheel to rotate.

25. A liquid distribution assembly for a liquid discharge mechanism having a nozzle, the liquid discharge mechanism discharging an output stream of liquid through the nozzle, the liquid distribution assembly comprising:

a wheel; and a support member mounted on the liquid discharge mechanism and having the wheel rotatably mounted thereon, the wheel being positioned downstream from the nozzle such that at least a portion of the output stream of liquid impacts the wheel to cause the wheel to rotate, and at least a portion of the wheel being disposed external to the housing, wherein at least a portion of the liquid in the at least a portion of the output stream of liquid impacts the wheel and is engaged by the wheel such that the portion of the liquid rotates with the wheel, and wherein the portion of the liquid engaged by the wheel is projected outwardly from the wheel by resultant forces of the rotation of the wheel; and wherein the wheel moves between an operative position wherein the at least a portion of the output stream of liquid impacts the at least a portion of the wheel to cause the wheel to rotate, and an inoperative position wherein the wheel is not impacted by the output stream of liquid when the wheel and the support member are mounted on the liquid discharge mechanism.

26. A liquid distribution assembly as defined in claim 25, wherein the wheel is fabricated from an absorbent material.

27. A liquid distribution system as defined in claim 25, comprising a sound generation mechanism mounted on at least one of the liquid discharge mechanism, the wheel and the support member, the sound generation mechanism generating a sound when the at least a portion of the of the output stream of liquid impacts the wheel to cause the wheel to rotate.

* * * * *